United States Patent [19]

McKay

[11] Patent Number: 4,750,308

[45] Date of Patent: Jun. 14, 1988

[54] HEAT RESISTANT, INSULATED WALL CONSTRUCTION

[76] Inventor: Harry McKay, 100 Clappison Blvd., West Hill, Ontario, Canada, M1C 2H1

[21] Appl. No.: 12,452

[22] Filed: Feb. 9, 1987

[51] Int. Cl.[4] ..... E04B 1/16; E04B 2/00

[52] U.S. Cl. ..... 52/379; 52/426; 52/428; 52/442; 24/573

[58] Field of Search ..... 52/378, 379, 426, 428, 52/442, 507, 508, 512, 513; 24/573, 458, 702; 174/135 D

[56] References Cited

U.S. PATENT DOCUMENTS

| | | | |
|---|---|---|---|
| 1,578,511 | 3/1926 | Gladwin | 52/426 |
| 1,832,231 | 11/1931 | Menninger | 52/378 |
| 2,029,082 | 1/1936 | Odam | 52/426 |
| 2,918,814 | 12/1959 | Farina | 52/513 |
| 2,921,462 | 1/1960 | Wilson | 52/378 |
| 4,574,550 | 3/1986 | Maschdoff | 52/405 |
| 4,655,014 | 4/1987 | Kreeke | 52/426 |

FOREIGN PATENT DOCUMENTS

| | | | |
|---|---|---|---|
| 1187671 | 5/1985 | Canada | 52/426 |
| 536438 | 5/1922 | France | 52/428 |
| 1305705 | 8/1962 | France | 52/512 |

*Primary Examiner*—Carl D. Friedman
*Assistant Examiner*—Michael Safavi
*Attorney, Agent, or Firm*—Cullen, Sloman, Cantor, Grauer, Scott and Rutherford

[57] ABSTRACT

An insulated wall construction is formed of a pair of parallel, spaced apart foam plastic sheets and a poured-in-place concrete core filling the space between the sheets. The sheets are each formed of numerous smaller panels which are interconnected edge to edge to form their respective sheets. The sheets are secured together, before the concrete is poured, by means of numerous metal tie members. Each tie member is formed of a pair of parallel, elongated, thin, rigid sheet metal plates which are interconnected by thin, narrow, elongated sheet metal strips whose opposite ends are connected to the respective plates and with the strips being twisted along their lengths. Each of the plates are inserted within aligned edge pockets formed in the abutting edges of adjacent panels which assists in aligning and interconnecting the panels. The plates carry tooth-like clips which embed within the pocket walls to hold the panels from moving, due to hydrostatic forces, during the concrete pouring. The plates and the stirps dissipate heat, such as caused by fire, to increase the fire resistance and the insulation capacity of the wall construction.

10 Claims, 2 Drawing Sheets

HEAT RESISTANT, INSULATED WALL CONSTRUCTION

BACKGROUND OF INVENTION

A common technique for forming concrete walls for buildings is to provide a mold made of a pair of spaced apart, parallel sheets between which the concrete is poured and cured. Then the sheets are removed, leaving the finished concrete wall.

Insulated, composite concrete walls have been produced by using foam plastic sheets as the mold forming sheets and leaving these in place after the concrete is cured to provide a composite concrete-plastic sheathed wall. This requires forming the plastic mold forming sheets of numerous smaller plastic panels that are secured together, edge to edge, to make up a sheet.

Various types of tie members have been used to interconnect the mold forming sheets and to hold them in their spaced apart positions during the concrete casting operation. In casting composite walls using plastic mold forming sheets which remain with the concrete, prior tie members have included a pair of plates interconnected by horizontally extending tie rods. These plates have been fastened within pockets or recesses formed in the plastic panels so that they also assist in aligning and securing adjacent panels together to form a single sheet. An example of this type of construction is illustrated in Canadian Pat. No. 1,187,671, issued May 28, 1985 to Hunter.

In the foregoing tie members the plates, which are made of plastic materials, and the means for fastening the tie rods and the plates together, are subject to being easily damaged by heat due to fires. Moreover, because of the substantial hydrostatic forces encountered during the pouring of concrete, there is a tendency for the foam plastic panels to move or "float". The prior tie members are generally inadequate to completely prevent this kind of movement.

Consequently, the invention herein relates to an improved tie member and wall construction wherein the plastic panels are immobilized against "floating" or movement due to the hydrostatic pressures encountered in pouring and curing the concrete. In addition, the improved tie member structure is better able to resist and to dissipate heat so as to provide a better fire resistant wall construction without reducing the insulation value of the composite wall construction.

SUMMARY OF INVENTION

The invention contemplates forming tie members, for interconnecting plastic panels in poured-in-place concrete wall constructions, out of a parallel, rigid sheet metal plates that are interconnected by sheet metal strips. The strips are long, narrow and are twisted a number of times along their lengths. Their opposite ends are double bent to form U-shaped end hooks, which fit through pre-formed slots in the respective plates and are secured in place by mechanical fasteners, such as rivets.

This tie member construction provides a rigid device for maintaining the spacing between the opposed panels during the pouring and curing of the concrete. The multiple twists along the lengths of the tie strips interlock with the concrete and also function to dissipate heat into the concrete in the event that the tie member plates are subjected to the intense heat of a fire.

The tie members include tabs that are struck-out of the plates and bent outwardly to form teeth that embed into the plastic panels. Separate tooth forming clips also can be provided on the plates for embedding into the respective plastic panels. Thus, the tie member plates are positively connected to the panels, to overcome the tendency of the panels to "float" out of position during the pouring of the concrete.

An object of this invention is to provide a composite, concretefoam plastic, wall structure which is fire resistant and which provides good heat and cold insulation. The completed wall structure has a concrete core surfaced by foam plastic material, and an exterior covering formed of suitable construction sheeting, such as gypsum board or the like. In addition to surface bonding, the plastic panels and the concrete are interlocked mechanically by the twisted tie strips which dissipate and resist heat transmission through the wall.

Another object of this invention is to provide a simple, inexpensive system for assembling the panels and the tie members together on the job site, with minimum labor and without the need for special tools. This includes a simple, manual way of locking the tie members plates to the panels using no more than a conventional screwdriver.

These and other objects and advantages will become apparent upon reading the following description, of which the attached drawings form a part.

DETAILED DESCRIPTION

Figure 1:
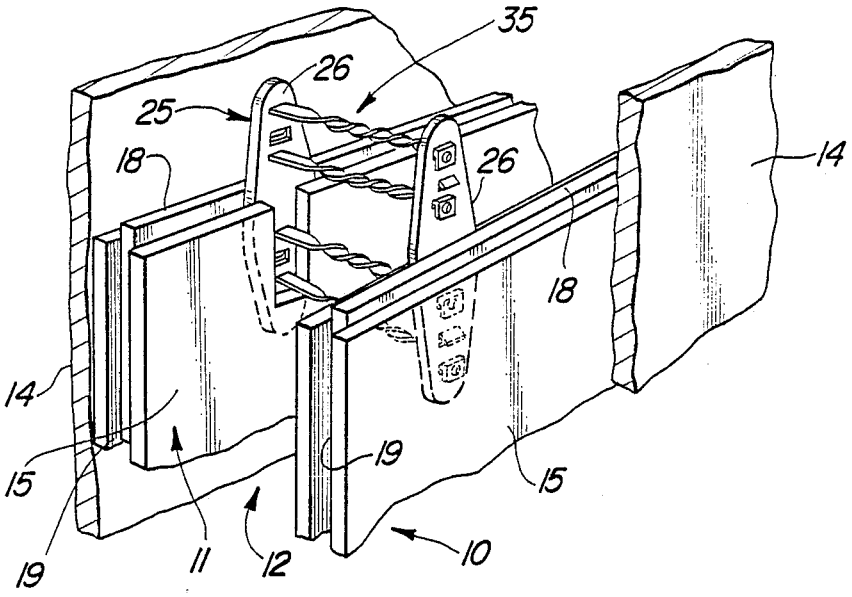
FIG. 1 is a perspective view of an assembly of a tie member connecting spaced panels together.
Figure 2:
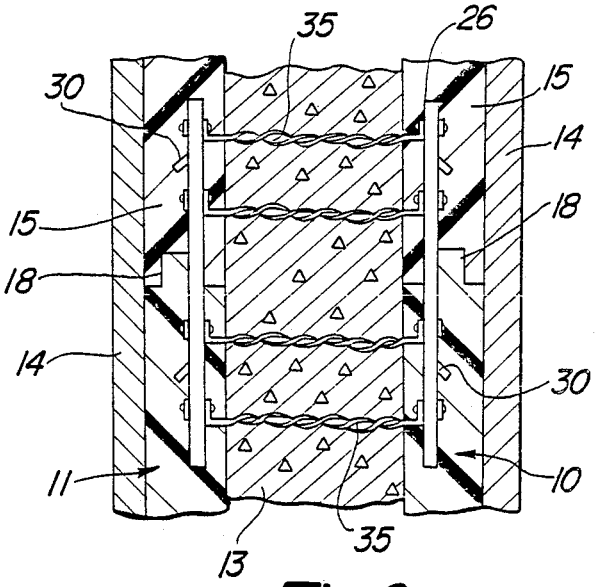
FIG. 2 is a cross-sectional view of a fragment of a finished wall construction.

FIG. 1 illustrates a pair of foamed plastic sheets 10 and 11 which are spaced apart to form a mold. Concrete is poured into the space 12 and is cured to form a composite wall construction made of a concrete core 13, sheets 10 and 11 and an exterior wall covering 14 formed of gypsum board or the like construction material.

Figure 3:
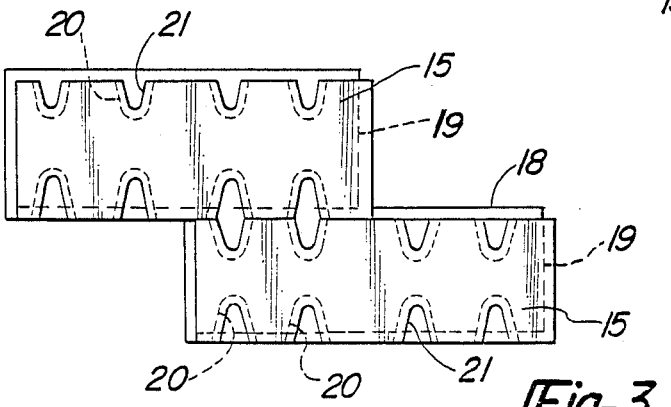
FIG. 3 is a reduced scale view of a pair of panels aligned together to form a portion of the wall forming plastic sheet.

The sheets are formed of numerous smaller panels 15, each provided with edge tongues 18 and grooves 19 for interconnecting their adjacent edges. In addition, each of the panels is provided with a number of spaced apart edge pockets 20 which open into the panel edges. The pockets also have side slots 21 opening at the interior faces of the panels. As illustrated in FIG. 3, the panels are aligned edge to edge with their pockets aligned but may be offset like rows of bricks.

The tie members 25 include rigid, sheet metal plates 26, as for example, 20–22 gauge galvanized steel. These plates are shaped to fit within the pockets 20 and their side edges 27 may be tapered somewhat for ease of insertion, as illustrated in FIG. 4.

A number of slots 28 are punched through the plates and adjacent each slot a hole 29 is formed. In addition, strike-out or knock-out tabs 30 are formed in the plates. These are normally left in the plane of the plates but may be bent out of the plane along an edge which is not severed. These tabs or clips function as teeth that embed into the plastic wall surface defining pockets in which the plates are inserted.

Figure 5:
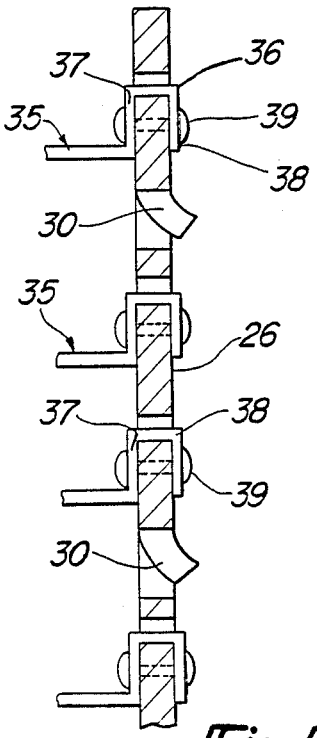
FIG. 5 is an enlarged, fragmentary cross-sectional view of the connections between a tie member plate and its tie strips.

The pairs of plates 26 are interconnected by tie strips 35, each of which is formed of a thin, stiff sheet metal material such as galvanized steel sheet of somewhat lesser gauge than the plates. The opposite ends of the strips are bent into inverted U-shaped hook-like formations 36 having parallel legs 37 and 38. The hooks are inserted through the slots 28 in the plates 26, as illustrated in FIG. 5, and may be mechanically fastened to the plates by suitable mechanical fasteners, such as rivets 39 extending through the plate holes 29 and corresponding holes 40 in the hook legs.

Figure 4:
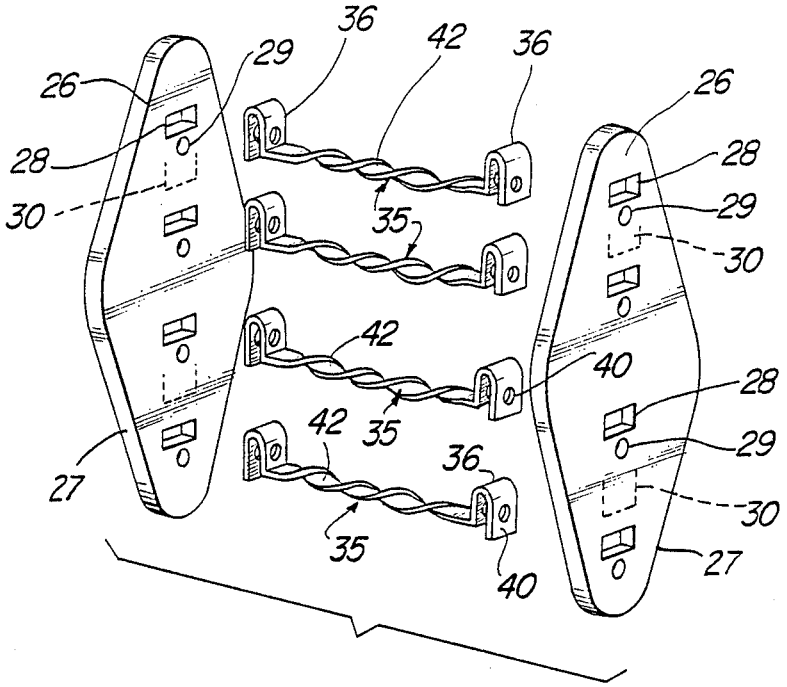
FIG. 4 is an enlarged, disassembled, perspective view of a tie member.

The tie strips are twisted 360 degrees a number of times along their lengths as illustrated by the twists 42 shown in FIG. 4. By way of example, to form an 8 inch thick wall, 10 inch long, tie strips twisted 4–5 times can be used. A 4–6 inch thick wall can use a tie strip of roughly 8 inches in length with about four or five twists.

The tie members may be pre-assembled and brought to the job site where the wall casting is to be performed. Alternatively, the separated parts may be brought to the job site and may be assembled by the workmen as they set up the plastic panels for the casting of the concrete walls. In that case, the tie strips can be manually inserted through the slots in the plates and riveted in place with a simple hand operated tool.

Once the tie member plates are inserted in the pockets of one horizontal row of panels, the new row of panels above it may be lowered upon the plates so that the plates serve to position and align the panels. To lock the panels from moving during the pouring of the concrete, the struck-out tabs may be manually pushed inwardly so as to dig into the plastic, utilizing an ordinary screwdriver or pointed tool. This can be done manually with little effort.

Figure 6:
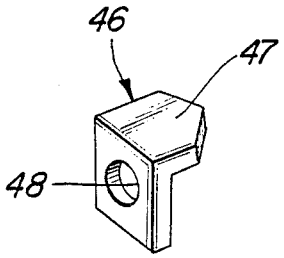
FIG. 6 is a perspective view showing a tooth forming clip.
Figure 7:
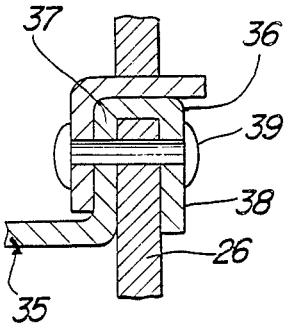
FIG. 7 shows the tooth forming clip in position for engaging the adjacent plastic panel.

As an alternative, or in some cases as an addition, separate metal clips may be provided for digging into the plastic. Such clips, illustrated in FIG. 6, may be formed of an L-shaped angle member 46 having a sharpened end leg 47. Its opposite leg has a hole 48. The clip can be manually pushed through a slot 28, through which one of the tie strips is already inserted and can be fastened in place by the same rivet that fastens the hook portion of its tie strip to the plate. This is illustrated in FIG. 7.

After the concrete is poured and cured, conventional facing sheets, such as gypsum board, may be applied to the wall. This can be done using adhesives or mechanical fasteners as is conventional. The composite structure has superior insulation qualities and can be attractive if properly finished.

Further, the tie members mechanically connect the plastic panels to the concrete and also, reinforce the concrete wall construction transversely. Because of its twisted construction, the tie members interlock with the concrete. Moreover, the twists help to dissipate heat rapidly so as to increase the heat resistance of the wall, particularly against fire.

The plastic material utilized for the panels may be selected among those that are conventional and commercially available. Thus, the selection of the particular material forms no part of the invention herein and is left to those skilled in the art. Different plastic materials are commercially available for this purpose.

Having fully described an operative embodiment of this invention, I now claim:

1. An insulated wall construction comprising:

a pair of parallel, spaced apart, foam plastic sheets, each formed of numerous smaller panels that are engaged together edge to edge to form a sheet;

a poured and cured in place concrete core filling the space between the sheets to form a composite plastic-concrete-plastic structure;

aligned pockets formed in at least some of the engaged edges of adjacent panels, each pocket having an open slot formed through the wall surface into the interior of the pocket and facing toward the opposing panel;

tie members for interconnecting and immobilizing the panels and the sheets during the pouring and curing of the concrete, with said tie members each comprising a pair of elongated, thin, rigid sheet metal plates having opposite surfaces, said plates are sized and shaped to snugly fit into a pair of aligned edge pockets, and a number of thin, narrow, sheet metal strips having opposite ends and extending between each pair of plates, with the opposite ends of the strips extending through the pocket slots into the pockets and connected to the plates;

a portion of the opposite ends of each of the strips being bent into a U-shape having at least two legs and a bight, with the legs of the U-shape at right angles to an initial plane of each strip, and with the bight of the U-shape extending through a corresponding slot formed through the plate so that the legs are arranged parallel to the opposite surfaces of the plate;

said legs being secured together and to the plates by means of mechanical fastener means, such as a rivet, extending through the legs and portions of the plate which the legs overlie;

and tooth members carried by the plates for embedding into the plastic panels adjacent thereto;

wherein the tie members rigidly hold the panels in position prior to and during the pouring of the concrete, thereby forming a casting mold for the concrete, and mechanically fasten the panels and concrete core together, and further, rapidly dissipate heat, such as due to fire, applied to one surface of the wall, into the concrete core for increasing the heat resistance and insulation capacity of the wall.

2. A wall construction as defined in claim 1, and a length of each of said strips being twisted 360 degrees a number of times along said length.

3. A wall construction as defined in claim 1, and including each plate being formed with pre-punched strike-out tooth forming portions which are separated from adjacent plate portions except for an integral hinge forming portion, with the tooth forming portions normally being in a plane of the plates, but being manually bendable at an angle to the plates so as to embed into the adjacent panel portions when manually bent.

4. A wall construction as defined in claim 1, and including a number of L-shaped clips each having a pointed leg inserted through a slot in the plate for insertion into the plastic panel adjacent thereto and another leg fastened to the plate.

5. A tie member for interconnecting spaced apart parallel sheets, that are formed on numerous edge to edge connected plastic panels, for pouring-in-place and curing a concrete core between the sheets to produce a composite, insulated wall construction, comprising:

a pair of elongated, parallel, rigid, thin sheet metal plates having a pair of opposite surfaces, said plates are interconnected by a number of tie strips, with each tie strip having opposite end portions and with each tie strip being formed of a narrow, elongated strip of sheet metal, and the opposite end portions of each tie strip bent into a flat U-shape having two legs and a bight, with the legs at right angles to an initial plane of the strip;

the bight of each U-shape bent portion extending through a slot formed in the plate, so that the legs are parallel to the opposite surface of the plate;

mechanical fastener means extending through the legs of the U-shape bent portion and the plate portion for securing the tie strip and plate together;

and tooth means carried by the plate for embedding in the surface of an adjacent panel portion;

said plates being sized and shaped to snugly fit into open end, slotted side, aligned pockets formed in adjacent edge portions of adjacent panels, with the tie strips arranged to extend transversely through the pocket slots;

whereby the tie members rigidly secure together the parallel sheets and hold the panels against movement caused by, hydrostatic pressure during casting of the concrete and further, the tie strips and plates dissipate into the concrete localized high heat, such as may be caused by fire, to produce a more fireresistant wall construction.

6. A tie member as defined in claim 5, and including a length of each of said tie strips being twisted 360 degrees a number of times along said length.

7. A tie member as defined in claim 5, and including each plate being formed with integral clips for embedding within adjacent surface portions of the pockets, with the clips being formed of pre-punched, knock-out tooth forming tabs that are defined by severing said tab portions from the plate except for an integral hinge forming area so that the tooth forming tab portions are normally contained within a plane of the plate but can be manually bent at an angle to the plate for embedding into the adjacent pocket portions.

8. A tie member as defined inclaim 5, and including a number of L-shaped clips each having a pointed leg which is inserted through a slot in the plate for insertion into the adjacent panel portion, and each having another leg fastened to the plate.

9. An insulated wall construction comprising:

a pair of parallel, spaced apart, foam plastic sheets, each formed of numerous smaller panels that are engaged together edge to edge to form a sheet;

a poured and cured in place concrete core filling the space between the sheets to form a composite plastic-concrete-plastic structure;

aligned pockets formed in at least some of the engaged edges of adjacent panels, each pocket having an open slot formed through the wall surface into the interior of the pocket and facing toward the opposing panel;

tie members for interconnecting and immobilizing the panels and the sheets during the pouring and curing of the concrete, with said tie members each comprising a pair of elongated, thin, rigid sheet metal plates that are sized and shaped to snugly fit into a pair of aligned edge pockets;

a number of thin, narrow, sheet metal strips having opposite edges and extending between each pair of plates, with the opposite edges of the strips extending through the pocket slots into the pockets and connected to the plates;

tooth members carried by the plates for embedding into the plastic panels;

and a number of L-shaped clips each having a pointed leg inserted through a slot in the plate for insertion into a portion of the plastic panel adjacent thereto, and each having another leg fastened to the plate;

wherein the tie members rigidly hold the panels in position prior to and during the pouring of the concrete, thereby forming a casting mold for the concrete, and mechanically fasten the panels and concrete core together, and further, rapidly dissipate heat, such as due to fire, applied to one surface of the wall, into the concrete core for increasing the heat resistance and insulation capacity of the wall.

10. A wall construction as defined in claim 9, and a length of each of said strips being twisted 360 degrees a number of times along said length.

* * * * *